US011628457B2

(12) United States Patent
Taiana et al.

(10) Patent No.: US 11,628,457 B2
(45) Date of Patent: Apr. 18, 2023

(54) DEVICE FOR INTERRUPTION-FREE COATING CAN BODIES AND OPERATING METHOD

(71) Applicant: Soudronic AG, Bergdietikon (CH)

(72) Inventors: Peter Taiana, Bergdietikon (CH); Pascal Gauch, Bergdietikon (CH)

(73) Assignee: SOUDRONIC AG, Bergdietikon (CH)

( * ) Notice: Subject to any disclaimer, the term of this patent is extended or adjusted under 35 U.S.C. 154(b) by 400 days.

(21) Appl. No.: 16/623,431

(22) PCT Filed: Feb. 28, 2018

(86) PCT No.: PCT/CH2018/000005

§ 371 (c)(1),
(2) Date: Dec. 17, 2019

(87) PCT Pub. No.: WO2018/232535

PCT Pub. Date: Dec. 27, 2018

(65) Prior Publication Data

US 2020/0114380 A1 Apr. 16, 2020

(30) Foreign Application Priority Data

Jun. 21, 2017 (CH) ..... 0813/17

(51) Int. Cl.
*B05B 9/04* (2006.01)
*B05B 13/00* (2006.01)

(52) U.S. Cl.
CPC ..... *B05B 9/04* (2013.01); *B05B 13/00* (2013.01)

(58) Field of Classification Search
CPC ... B05B 9/04; B05B 13/00; Y10T 137/86187; Y10T 137/86196
See application file for complete search history.

(56) References Cited

U.S. PATENT DOCUMENTS 3,893,625 A * 7/1975 Wiggins ..... B05B 9/00 239/71
4,450,981 A * 5/1984 Haig ..... B65B 37/14 222/64

(Continued)

FOREIGN PATENT DOCUMENTS

CN 202316168 U 7/2012
CN 202 909 858 U 5/2013

(Continued)

OTHER PUBLICATIONS

International Search Report for International Application No. PCT/CH2018/000005 dated Apr. 30, 2018.

(Continued)

*Primary Examiner* — Justin M Jonaitis
(74) *Attorney, Agent, or Firm* — McCormick, Paulding & Huber PLLC

(57) ABSTRACT

A device for interruption-free coating of can bodies with a coating liquid comprises an inlet container for providing the coating liquid to be applied, a pressurized air source for supplying pressurized air, an application nozzle for spraying the coating liquid with an application pressure onto the container body. An intermediary container is provided, which is connected on the inlet side to the inlet container by means of the inlet pipe and which is connected on the outlet side to the application nozzle by means of an outlet pipe.

14 Claims, 1 Drawing Sheet

(56) References Cited

U.S. PATENT DOCUMENTS

| | | | | |
|---|---|---|---|---|
| 4,676,404 | A * | 6/1987 | Yamazaki | B67D 7/72 222/61 |
| 5,636,762 | A * | 6/1997 | Juhola | H01L 21/67086 222/64 |
| 6,695,017 | B1 * | 2/2004 | Liedtke | G05D 16/2013 141/4 |
| 2002/0161479 | A1 | 10/2002 | Mathewes et al. | |

FOREIGN PATENT DOCUMENTS

| | | | |
|---|---|---|---|
| CN | 205731702 | U | 11/2016 |
| CN | 106259274 | A | 1/2017 |
| EP | 2 698 445 | A2 | 2/2014 |
| EP | 3 117 905 | A1 | 1/2017 |
| JP | S55-70365 | A | 5/1980 |
| JP | S5570365 | A * | 5/1980 |
| WO | 2014/102258 | A1 | 7/2014 |

OTHER PUBLICATIONS

Search Report for Taiwan Patent Application No. 107101496 dated May 21, 2021.

* cited by examiner

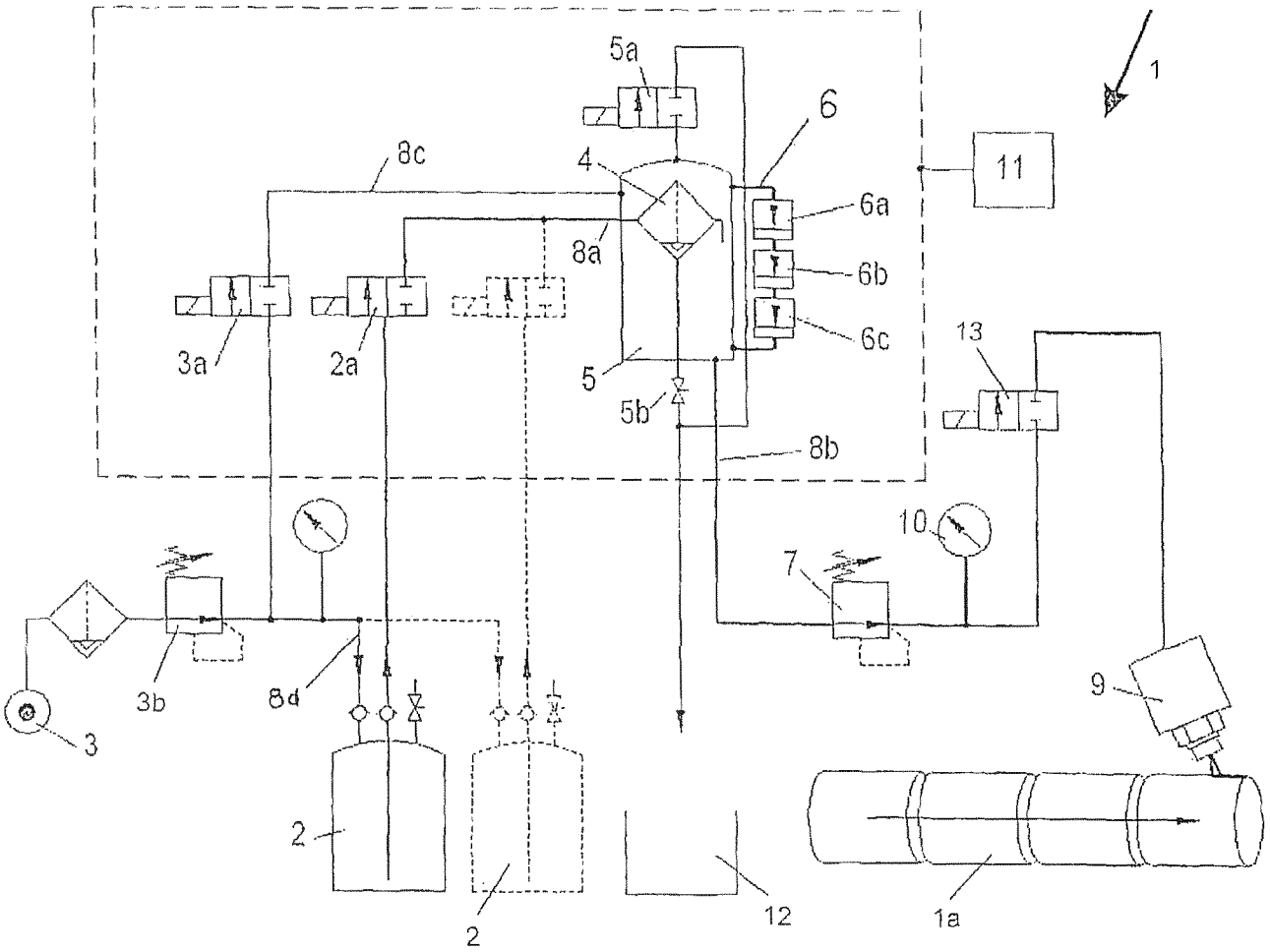
1
11
6
6a
6b
6c
5a
4
8a
5
5b
8b
13
10
7
9
1a
12
2
8c
2a
3a
8d
3b
3

DEVICE FOR INTERRUPTION-FREE COATING CAN BODIES AND OPERATING METHOD

CROSS REFERENCE TO RELATED APPLICATIONS

This application is a National Stage application of International Patent Application No. PCT/CH2018/000005, filed Feb. 28, 2018, which claims the priority of Swiss patent application 0813/17, filed Jun. 21, 2017, the disclosure of which is incorporated herein by reference in its entirety.

TECHNICAL FIELD OF THE INVENTION

The invention relates to a device for interruption-free coating of a series of can bodies and to a method for interruption-free operation of the device according to the respective independent claim.

BACKGROUND OF THE INVENTION

Devices for coating can bodies are known. They are particularly paint spraying systems for the exterior seam of can bodies. These systems are used for coating the welding seam of can bodies, such that they are protected against corrosion. Typically, in a production line for cans such a system is arranged downstream of a welding machine which welds metal sheets shaped as cylinders to can bodies. Further processing stations may be provided downstream of the paint spraying system. In available systems the coating of the can bodies, which come out of the welding machine with high cadence, is done in such a way that paint is transported under pressure out of a paint container to an application nozzle which sprays the paint as thin layer on the surface to be coated of the respective can body. A disadvantage of this solution is to be seen in the fact that the paint container has to be replaced once it is empty, thereby resulting in an undesired production interruption. If on the other hand the production is not interrupted, air enters the transport system until a new paint container is ready, thereby leading at the exit to faulty coatings of a number of cans. Consequently, an equally undesired discharge of these can bodies would result in this case.

SUMMARY

The objective of the invention is to provide a device for interruption-free coating of a series of can bodies and an operating method, which increase efficiency during production of can bodies or cans, respectively.

This objective is reached by a device for interruption-free coating of can bodies and by a corresponding operating method according to the independent claims.

According to this, in a first aspect of the invention a device for interruption-free coating of can bodies with a coating liquid is provided. The device comprises

- at least an inlet container for providing the coating liquid to be applied,
- at least a pressurized air source for supplying pressurized air, which is adapted to transport pressurized air with a transport pressure into the inlet container in order to transport coating liquid out of the inlet container through an inlet pipe, and
- at least an application nozzle for applying, particularly spraying, the coating liquid with an application pressure onto the container body.

Furthermore, an intermediary container is provided in the device, which is connected on the inlet side to the inlet container by means of the inlet pipe and which is connected on the outlet side to the application nozzle by means of an outlet pipe.

In a second aspect of the invention, a method for interruption-free operation of the aforementioned device is provided.

In a first step, the intermediary container is filled up to a target filling level with coating liquid out of the inlet container by means of pressurized air from the pressurized air source with a transport pressure. An aeration valve of the intermediary container is configured in such a way that during the filling process of the intermediary container with coating liquid air can simultaneously escape from the intermediary container through the aeration valve.

In a second step, the application of the coating liquid on the can bodies is initiated by transporting coating liquid out of the intermediary container to the application nozzle and applying it onto the respective can body by the latter.

During the application of the coating liquid, in operation as intended of the device, a target filling level of the coating liquid in the intermediary container is monitored by at least one filling level sensor in a continuous step.

As soon as in a third step it is determined by means of the at least one filling level sensor that the nominal filling level falls below the target filling level and thus the inlet container is empty, the following steps are carried out.

Firstly, in a fourth step, the transport of the coating liquid out of the intermediary container to the application nozzle is maintained by transporting air from the pressurized air source through a pressurized air pipe into the intermediary container.

Subsequently, in a fifth step, the empty inlet container is replaced by at least a new inlet container, while the coating liquid is still transported out of the intermediary container to the application nozzle.

In a sixth step, the supply of the intermediary container with coating liquid out of the at least one new inlet container is continued only after determining that the new inlet container is connected to the inlet pipe as intended. The application of the coating liquid onto the can bodies is not interrupted during this time.

The processes starting with the third step are repeated until another action requires a stop of the method, e.g. as soon as all can bodies of a batch have been coated or the device has to be maintained or cleaned.

By the device and the corresponding operating method according to the invention, the production of can bodies is more efficient because the coating doesn't have to be interrupted while the inlet container is replaced. In case of the device, this is particularly due to the fact that the coating can be continued during the unavoidable replacement of the inlet container, by providing the coating liquid for this period out of the intermediary container. In this way it is therefore avoided that the device has to be switched off for the replacement period, which equals an interruption of the coating. If the device operation is continued during the replacement, air is also sucked in, like in case of available solutions, however it only reaches the intermediary container (buffer container) and not directly the application nozzle. Contrary to this, in case of known solutions the entry of air into the transport branch for the coating liquid results in an improper coating because the application nozzle delivers air instead of coating liquid during the replacement period of the inlet container, which de facto also means an interruption of the production.

BRIEF DESCRIPTION OF THE DRAWINGS

Further embodiments, advantages and applications of the invention result from the dependent claims and from the now following description by the drawing. The drawing shows a schematic view of a device according to the invention for interruption-free coating of can bodies.

DESCRIPTION OF THE PREFERRED EMBODIMENTS

Definitions and Notes

In the present context, the term "coating liquid" comprises all liquids suitable for coating, particularly metal coating, particularly clear and colored coating paint, particularly solvent-based or water-based paint with a viscosity between 12 and 18 s according to DIN 4. In the following, the term "paint" is used in a non-limiting way for simplicity reasons.

The term "application" comprises all possibilities of wetting a surface to be coated, wherein spraying the surface is preferred.

The term "transport pressure" is understood as the pressure built up by a corresponding pressure-generating device at the inlet of the device according to the invention (inlet-side) for transporting the paint. An "application pressure" is the pressure used at the outlet of the device according to the invention (outlet-side) for applying the paint. The real pressure present in the device between the inlet and the outlet may vary from these two pressures and is called "nominal pressure".

The term "maximum filling level" relates to an upper threshold value for the maximum allowable filling level of the paint in an intermediary container which is yet to be defined.

Accordingly, the term "minimum filling level" relates to a lower threshold value for the minimum allowable filling level of the paint in the intermediary container.

The term "target filling level" relates to a desired filling level of the paint in the intermediary container in operation as intended of the device according to the invention.

Finally, the term "nominal filling level" relates to a current filling level of the paint in the intermediary container, which is present at a measurement instant.

The term "in operation as intended" relates to the operation state of the device according to the invention, in which the nominal filling level of the paint substantially corresponds to the target filling level during coating.

In the present context, the term "pressure" is understood as a pressure which is higher than the atmospheric pressure.

In the drawing, the thicker lines denote the paint-transporting pipes. Pipes transporting pressurized air are not highlighted.

The drawing shows a schematic view of a device 1 according to the invention for interruption-free coating of can bodies, particularly of a series of can bodies, with a paint. It is understood that the device 1 may be used to coat a single can body, however a series or endless series, respectively, of can bodies is assumed for the following exemplary embodiment of the device for explaining the advantages of the device 1.

The device 1 comprises an inlet container 2 for providing the paint to be applied. A plurality of inlet containers 2 may also be provided (see inlet container shown in a dashed way), which may be filled with the same paint or with different components of a paint to be mixed. The inlet container 2 is connected to an intermediary container 5 via an inlet pipe 8*a*. A first valve 2*a* (e.g. a magnet valve) is arranged in the inlet pipe 8*a* at the inlet container, by means of which the delivery of paint out of the inlet container 2 may be switched on or off. Typically, the first valve 2*a* is in operation as intended entirely open and during the replacement of inlet containers 2 entirely closed, which will be explained in more detail further down.

Furthermore, the device 1 comprises a pressurized air source 3 for pressurized air. The pressurized air source 3 has multiple tasks.

A first task of the pressurized air source 3 is the transport of the paint out of the inlet container 2 through the inlet pipe 8*a* into the intermediary container 5. In order to do this, the pressurized air source 3 is connected to the inlet container 2 by means of a pipe 8*d*. For transporting the coating liquid into the intermediary container 5, pressurized air flows into the inlet container 2, e.g. with a transport pressure of 4 bar, preferably adjustable by means of an inlet pressure regulator 3*b*, and the paint is pressed into the inlet pipe 8*a*. In this context, it is noted that the entire device 1 preferably doesn't comprise pumps and the entire transport of the paint is carried out by pressurized air. Another suitable gas may however also be used instead of air, but air is preferred due to cost reasons. In an embodiment not shown here it is possible to use pumps instead of or additionally to the transport by means of pressurized air, which is however not preferred.

A second task of the pressurized air source 3 is the support for maintaining the transport of the paint out of the intermediary container 5 to the application nozzle 9 while an empty inlet container 2 is replaced by a new inlet container 2 (see fourth step of the method according to the invention). For this, the pressurized air source 3 is connected to the intermediary container 5 by means of a pressurized air pipe 8*c*. A second valve 3*a* is provided in the pressurized air pipe 8*c*, by means of which the pressurized air supply to the intermediary container 5 can be switched on or off. If it has been noticed that the inlet container 2 is empty, the valve 2*a* is closed and the valve 3*a* is opened. Hence, in this way the paint supply into the intermediary container 5 is interrupted and pressurized air is pumped into the intermediary container 5. Subsequently, the empty inlet container 2 may be replaced. The determination that the inlet container 2 is empty may be signaled to the user e.g. by an acoustic and/or optical signal.

Preferably, the pressurized air source 3 is adapted to maintain a substantially constant transport pressure during operation as intended of the device. The transport pressure is chosen higher than the application pressure, wherein this will be explained in more detail in the context of the application nozzle yet to be described. It is noted that independently from the fact that the transport pressure is kept as constant as possible, it is possible that pressure variations may arise during the course of the paint transporting transport stream, which may e.g. arise due to pipe losses or an occurring aeration. The pressurized air source 3 is adapted to be able to compensate such pressure variations. In other words, in an embodiment of the device according to the invention the transport pressure may be adjusted due to such conditions.

A filter 4 is preferably arranged in the intermediary container 5 or in the inlet pipe 8*a*, which filters potentially present dirt particles from the paint.

As already mentioned, the inlet pipe 8*a* opens into the intermediary container 5. Particularly, it is desired that the opening of the inlet pipe 8*a* is arranged in the upper section of the intermediary container 5, wherein the upper section is assumed as a quarter of the entire height of the intermediary container.

An aeration valve 5*a* is also provided in this upper section, preferably on the top side of the intermediary container 5, by means of which air can be evacuated from the intermediary container 5. In this context it is preferred that a safety distance is kept between the aforementioned opening of the inlet pipe 8*a* in the intermediary container 5 and the aeration valve 5*a*, such that no paint can escape through the aeration valve 5*a* during the aeration. This safety distance may e.g. be provided if, as depicted in the figure, the opening is arranged on the side of the intermediary container 5 and the aeration valve 5*a* is arranged on top of the intermediary container 5.

An outlet valve 5*b* is provided on the bottom side of the intermediary container 5, which serves to empty the intermediary container 5, this being carried out e.g. in case of a pending cleaning of the intermediary container 5.

The intermediary container 5 is a pressure tank dimensioned for at least the maximum possible pressure in the device 1. Filling level sensors 6*a*, 6*b*, 6*c*, preferably three, (e.g. infrared barrier based sensors) for detecting a filling level of the paint in the intermediary container 5 are provided On the intermediary container 5, wherein in other embodiments a single filling level sensor or two filling level sensors may be provided as well. A first filling level sensor 6*a* serves to detect a maximum level of the paint in the intermediary container 5. A second filling level sensor 6*b* serves to detect a target filling level of the paint in the intermediary container 5. In other words, the second filling level sensor 6*b* detects if the nominal filling level is higher or at the same level or lower than the target filling level. A third filling level sensor 6*c* serves to detect a minimum level of the paint in the intermediary container 5. The task of the individual filling level sensors is explained in more detail further down in the context of the operating method according to the invention.

A gauging cylinder is provided outside, i.e. adjacent to the intermediary container 5, which is connected to the intermediary container 5 in a liquid transporting way and at which or inside which the filling level sensors 6*a*, 6*b*, 6*c* are arranged. The gauging cylinder typically has a diameter which is many times smaller than the intermediary container 5. The use of the gauging cylinder brings the advantage that more buffer time is gained because it is known earlier if the inlet container 2 is empty.

The intermediary container 5 is connected at the outlet to an application nozzle 9 via an outlet pipe 8*b*. The application nozzle 9 serves to apply, particularly spray, the paint with an application pressure of e.g. 2 bar or 2.5 bar onto the can body 1*a*. The outlet pipe 8*b* preferably starts at the bottom section of the intermediary container 5, preferably in the bottom quarter of the entire height of the intermediary container 5, particularly below the minimum filling level of the paint in the intermediary container 5, wherein this ensures that no air can enter the outlet pipe 8*b*. The arrangement of the opening of the inlet pipe 8*a* in the upper section of the intermediary container 5 and of the inlet of the outlet pipe 8*b* in the bottom section of the intermediary container 5 improves the decoupling of the outlet pipe 8*b* from the inlet pipe 8*a* with regard to the influence of air which can enter the inlet pipe when the inlet container 2 is replaced. According to this, this air is indeed transported into the intermediary container 5 through the inlet pipe 8*a*, however it stays in the upper section of the intermediary container 5 and can be disposed of in a simple manner by means of the aeration valve 5*a*, avoiding that it can enter the outlet pipe 8*b*.

A pressure regulator 7 for regulating the application pressure, which is operable in a manual or automatic way in order to spray the paint by means of the application nozzle 9 is provided in the outlet pipe 8*b*. As mentioned above, the transport pressure is chosen to be higher than the application pressure, in this example 4 bar or 2 or 2.5 bar, respectively. In this way it is ensured that enough pressure is build up, as seen from the inlet side of the device 1, in order to provide the necessary spraying effect of the application nozzle 9, because the pure hydrostatic pressure caused by the paint column in the intermediary container 5 is not sufficient for all requirements of the coating of the can bodies 1*a*. The pressure in the intermediary container 5 substantially corresponds to the transport pressure, therefore here e.g. 4 bar. For simplicity reasons potential pressure losses in the inlet pipe, etc. are not taken into account in this context. An advantage of these pressure conditions is that the application pressure is made controllable from the inlet side of the device 1, even when e.g. the pressure regulator 7 is not present.

Furthermore, an outlet valve 13 is provided in the outlet pipe 8*b*, by means of which the paint supply to the application nozzle 9 can be switched on or off. In operation as intended of the device according to the invention, the valve 13 typically remains closed until can bodies 1*a* arrive for coating, whereafter the paint supply is switched on.

The device according to the invention preferably comprises a control unit 11. In the drawing, the control unit 11 is connected to the ensemble of elements of the device 1 according to the invention, which is enclosed by the dashed square. Obviously, it may be connected to further elements of the device 1 according to the invention, e.g. with the pressure regulator 7 or with the inlet pressure regulator 3*b*. The control unit 11 may carry out different tasks of the following tasks individually or in combination:

- Controlling of the first valve 2*a* and of the second valve 3*a*,
- Monitoring the nominal filling level of the intermediary container 5, particularly by querying the second filling level sensor 6*b*,
- Controlling the application pressure, particularly control the pressure regulator 7, particularly querying the pressure sensor 10,
- Controlling the outlet valve 5*b*,
- Controlling the aeration valve 5*a*,
- Controlling the outlet valve 13,
- Monitoring the state of the filter 4,
- Provide a user interface for inputting and outputting data, and
- Switching automatically from an empty inlet container to a full inlet container, if the device comprises multiple inlet containers 2 with corresponding switching capabilities. However, this task is normally performed manually.

The valves 2*a*, 3*a*, 5*b* and the pressure regulator 7 may also be controlled manually.

In the following, an operating method according to the invention is described, by means of which the device according to the invention is operated.

The method for interruption-free operation of the device comprises the following already mentioned steps:

Step 1: Filling up the intermediary container 5 to a target filling level with paint out of the inlet container 2 by means of pressurized air from the pressurized air source 3 with a transport pressure. This step may also be regarded as preparatory step and only has to be carried out once at the beginning of a coating process. The pressure build up in the transport branch of the paint up to the pressure regulator 7 is also assumed as part of this phase. If a test run is scheduled, the application pressure downstream of the pressure regulator 7 may be set or adjusted, respectively, manually or automatically by the pressure regulator 7 during the spraying of test bodies. Otherwise, the setting of the application pressure may be done by the pressure regulator 7 once during startup of the device according to the invention. For this first step, the aeration valve 5*a* of the intermediary container 5 is configured in such a way that, during the filling process of the intermediary container 5 with coating liquid, air which is displaced by the paint flowing into the intermediary container 5 can simultaneously escape from the intermediary container 5 through the aeration valve 5*a*. For accomplishing this, the aeration valve 5*a* can be controlled by the state of the filling level sensor 6*b* and of the control unit 11.

Step 2: Initiation of the spraying of the paint on the can bodies 1*a*, particularly on the outer seam of the can bodies 1*a*, by transporting paint with application pressure (starting from the pressure regulator 7) out of the intermediary container 5 to the application nozzle 9 which applies it onto the respective can body. This is done indirectly by the transport pressure of the pressurized air source 3. The application nozzle 9 is dimensioned correspondingly in such a way that the coating beam can be adjusted to the width of the section to be coated.

Continuous step: This step may be carried out anytime, preferably periodically at prescribed time intervals, and may therefore overlap step 1 and/or 2. In operation as intended of the device 1, the target filling level of the paint in the intermediary container 5 is monitored by the second filling level sensor 6*b* during spraying of the paint.

Step 3: Determining by carrying out the above continuous step that the nominal filling level has dropped below the target filling level. This may be accomplished by querying the second paint sensor 6*b* by means of the control unit 11. This determination is carried out at least when the inlet container 2 is empty. In this case the paint level in the intermediary container 5 drops as on the outlet side paint is still used for coating, however on the inlet side no paint is delivered to the intermediary container 5. Preferably, the determination that the inlet container 2 is empty is acknowledged only if either the paint didn't reach the target filling level during a certain time interval or if the nominal filling level has dropped below the target filling level by a certain factor. If this determination has been acknowledged, an acoustic and/or visual signal may preferably be issued, as already mentioned.

It is preferred to provide a tolerance threshold for small variations of the nominal filling level of the paint. If the nominal filling level varies around the target filling level, every time it drops below the target filling level it would be assumed that the inlet container 2 is empty and consequently the acoustic or optical signal would erroneously be issued. This tolerance threshold programmed in the control unit 11 avoids this case in the aforementioned way.

Additionally or alternatively to this type detecting that an inlet container is empty, it is also possible to provide a detection unit by means of which air bubbles in the inlet pipe are detected.

Step 4: Maintaining the transport of the coating liquid out of the intermediary container 5 to the application nozzle 9 by transporting air from the pressurized air source 3 through the pressurized air pipe 8*c* into the intermediary container 5. This is done by opening the second valve 3*a*. Only then is the first valve 2*a* closed and the empty inlet container 2 decoupled.

According to this, at step 4 the transport pressure in the intermediary container 5 is maintained. In this way it is ensured that there is still enough pressure for spraying at the application nozzle 9, which is still in operation during the replacement of the inlet container 2.

Step 5: Replacement of the empty inlet container 2 by at least a new inlet container 2, while the paint is still transported to the application nozzle 9 out of the intermediary container 5. If multiple inlet containers 2 are connected, the replacement may take place in such a way that it is switched from a first empty inlet container 2 to a second inlet container 2. The filling level of the second inlet container 2 is checked in advance in order to make sure that it is full. If all inlet containers 2 are empty, they are refilled or replaced.

Step 6: Continuation of the supply of the intermediary container 5 with coating liquid out of the at least one new inlet container 2. This is done only after it has been determined that the new inlet container 2 is connected to the inlet pipe 8*a* as intended. The application of the coating liquid onto the can bodies 1*a* is not interrupted during this time. The supply of the intermediary container 5 with paint is resumed by reopening the first valve 2*a* after the second valve 3*a* has been closed.

As already mentioned, the application pressure may be adjusted by means of the pressure regulator 7 of the device 1 in such a way that it is smaller than the transport pressure by a prescribed factor. This factor is preferably chosen in the range between 1.5 and 2.

Preferably, the transport of the paint from the inlet container 2 is halted when a maximum filling level of the paint in the intermediary container 5 is reached, until the nominal filling level falls again below the maximum filling level (closing of the first valve 2*a*). This state may be reported to the control unit 11 by the first filling level sensor 6*a*. However, such a case can only arise if the aeration valve 5*a* is open. In this case, the air in the intermediary container 5, which makes sure that the liquid level cannot rise higher than a certain level due to the present overpressure in operation as intended of the device, can escape and be replaced by the rising nominal filling level of the paint. The aeration valve 5*a* may e.g. be opened in operation when air bubbles are contained in the paint flowing into the intermediary container 5 and they have to be evacuated from the intermediary container 5. If this excess air wouldn't be evacuated, too much air would potentially be present in the intermediary container 5 and the target filling level of the paint wouldn't be reached due to the present pressure, which has to be avoided. Therefore, the rise of the nominal filling level may be limited by closing the aeration valve 5*a*. Alternatively or additionally, pressurized air from the pressurized air source 3 can be transported into the intermediary container 5 through the pressurized air pipe 8*c*.

Furthermore, a maximum permissible duration of this state of exceeding the maximum filling level may be defined, after which the device is switched off. If the nominal filling level falls again below the maximum filling level during this time, the paint transport from the inlet container 2 may be resumed. In this context, it is noted that the maximum state normally cannot be exceeded when the aeration valve 5*a* is closed, because a "natural" balance is reached due to the overpressure in the supply branch up to the pressure regulator 7. This means that no more paint can flow into the intermediary container from a certain level on.

Preferably, the device is stopped when the filling level falls below a minimum filling level of the coating liquid in the intermediary container 5. Optionally, a time duration may also be defined for this case, after which the switching off is carried out.

For a device for coating can bodies, the present invention makes it possible that no interruption of the coating occurs during replacement of the inlet container, by adding the intermediary container to the transport branch of the paint, and therefore the coating of the can bodies can be carried out more efficiently. Accordingly, the method according to the invention allows a continuous coating of the can bodies without having to interrupt production each time when an inlet container must be replaced. Hence, costs are saved in this way and production is more efficient.

While presently preferred embodiments of the invention are shown and described in this document, it is distinctly understood that the invention is not limited thereto but may be embodied and practiced in other ways within the scope of the following claims. Therefore, terms like "preferred", "in particular", "particularly", or "advantageously", etc. signify optional and exemplary embodiments only.

What is claimed is:

1. A device for interruption-free coating of can bodies with a coating liquid, comprising an inlet container for providing the coating liquid to be applied to can bodies;

a pressurized air source for supplying pressurized air, which is adapted to deliver pressurized air with a transport pressure into the inlet container in order to transport coating liquid out of the inlet container through an inlet pipe an application nozzle for applying the coating liquid with an application pressure onto the can bodies, an intermediary container which is connected on its inlet side to the inlet container by means of the inlet pipe, and which is connected on its outlet side to the application nozzle by means of an outlet pipe;

a filling level sensor connected with the intermediary container for detecting a target filling level of the coating liquid, in the intermediary container;

the pressurized air source is also connected to the intermediary container by means of a pressurized air pipe; and a control unit for controlling the transport pressure and monitoring the filling level sensor connected with the intermediate container for delivering pressurized air from the pressurized air source through the pressurized air pipe to the intermediary container when it is determined from the filling level sensor that the nominal filling level has fallen below the target filling level indicating that the inlet container is empty and needs to be replaced.

2. The device according to claim 1, wherein a pressure regulator for regulating the application pressure for applying the coating liquid by means of the application nozzle is provided in the outlet pipe.

3. The device according to claim 1, wherein a gauging cylinder is provided outside the intermediary container, which gauging cylinder is connected to the intermediary container in a liquid transporting way and at which or inside of which the filling level sensor is arranged.

4. The device according to claim 1, wherein the intermediary container is a pressure tank, wherein an aeration valve is provided at the upper side of the intermediary container and an outlet valve is provided at the bottom side of the intermediary container.

5. The device according to claim 1, wherein the pressurized air source is adapted to maintain a substantially constant transport pressure during an operation as intended of the device, which transport pressure is equal to the application pressure or is higher than the application pressure.

6. The device according to claim 1, wherein the inlet container has a first valve and the pressurized air source has a second valve, which valves are switchable between an opened state and a closed state for regulating the fluid quantity exiting the inlet container or the pressurized air source, respectively.

7. The device according to claim 1, wherein the outlet pipe is connected to the intermediary container at the bottom of the same.

8. The device according to claim 1, wherein:

the intermediary container additionally includes a maximum filling level sensor for detecting a maximum intended filling level of the coating liquid in the intermediary container; and the control unit is responsive to the maximum filling level sensor to halt the transport of the coating liquid to the intermediary container when the maximum filling level is reached.

9. The device according to claim 1, wherein:

the intermediary container additionally includes a minimum filling level sensor for detecting a minimum intended filling level of the coating fluid in the intermediary container; and the control unit is responsive to the minimum filling level sensor to stop the operation of the device when the filling level of the coating liquid in the intermediary container falls below the minimum filling level.

10. A method for an interruption-free operation of a device according to claim 1, wherein in a first step the intermediary container is filled up to a target filling level with coating liquid out of the inlet container by means of pressurized air from the pressurized air source with a transport pressure, wherein an aeration valve of the intermediary container is configured in such a way that during the filling process of the intermediary container with coating liquid air can simultaneously escape from the intermediary container through the aeration valve;

in a second step the application of the coating liquid on the can bodies is initiated by transporting coating liquid out of the intermediary container to the application nozzle and applying it onto the respective can body by the latter;

wherein in operation as intended of the device in a continuous third step a target filling level of the coating liquid in the intermediary container is monitored by the filling level sensor during the application, of the coating liquid;

wherein, as soon as in the third step it is determined by means of the filling level sensor that the nominal filling level in the intermediary container has fallen below the target filling level and thus indicated that the inlet container is empty:

firstly in a fourth step the transport of the coating liquid out of the intermediary container to the application nozzle is maintained by transporting air from the pressurized air source through a pressurized air pipe into the intermediary container, subsequently in a fifth step the empty inlet container is replaced by at least a new inlet container, while the coating liquid is still transported to the application nozzle out of the intermediary container, and in a sixth step the supply of the intermediary container with coating liquid out of the at least one new inlet container is continued only after determining that the new inlet container is connected to the inlet pipe as intended, wherein the application of the coating liquid onto the can bodies is not interrupted during this time.

11. The method according to claim 10, wherein the application pressure is adjusted by means of a pressure regulator of the device in such a way that it is lower than the transport pressure by a prescribed factor.

12. The method according to claim 10, wherein the transport of the coating liquid from the inlet container is halted when a maximum filling level of the coating liquid in the intermediary container is reached, until the nominal filling level falls again below the maximum filling level, and/or the aeration valve is closed and/or pressurized air is transported from the pressurized air source through the pressurized air pipe into the intermediary container.

13. The method according to claim 10, wherein the device is stopped when the filling level falls below a minimum filling level of the coating liquid in the intermediary container.

14. The method according to claim 10, wherein after the third step a query is issued by the control unit, if the inlet container is really empty, and only in this case the fourth step is initiated, wherein otherwise the second step is continued.

* * * * *